United States Patent [19]

Bruderly et al.

[11] 3,971,477

[45] July 27, 1976

[54] FRAMING AND MODULAR BASE UNIT STRUCTURE FOR DISPLAY FIXTURES

[75] Inventors: Roland L. Bruderly, Alliance; Edward A. Tomayko, Uniontown, both of Ohio

[73] Assignee: Roland L. Bruderly, Alliance, Ohio

[22] Filed: Mar. 10, 1975

[21] Appl. No.: 556,660

[52] U.S. Cl. ..... 211/189; 52/36; 52/264; 108/64; 108/114; 211/182; 211/190

[51] Int. Cl.[2] ..... A47F 5/16

[58] Field of Search ..... 211/148, 177, 182; 52/36, 263, 264, 234; 108/64, 111, 114

[56] References Cited

UNITED STATES PATENTS

| | | | |
|---|---|---|---|
| 2,447,704 | 8/1948 | Kline | 211/148 X |
| 2,631,913 | 3/1953 | Rosenberg | 211/148 X |
| 2,719,633 | 10/1955 | Rosenberg | 211/148 X |
| 2,958,427 | 11/1960 | Bianchi | 211/148 |
| 2,991,889 | 7/1961 | Levy et al. | 211/177 |
| 3,015,466 | 1/1962 | Levy | 211/177 X |
| 3,081,718 | 3/1963 | Shoffner | 211/148 X |
| 3,160,281 | 12/1964 | Ruhnke | 211/177 |
| 3,383,821 | 5/1968 | Gatch | 211/177 X |
| 3,502,292 | 3/1970 | Yoder | 211/177 X |
| 3,733,755 | 5/1973 | Butler | 211/177 X |

*Primary Examiner*—Roy D. Frazier
*Assistant Examiner*—Thomas J. Holko
*Attorney, Agent, or Firm*—P. D. Golrick

[57] ABSTRACT

A skeleton structure for a free standing wall type or a gondola type fixture assembly, comprising modular base units secured successively to each other as a base structure by uprights of framing for selectable superstructure. A modular primary base unit, of generally hollow rectangular plan form, fabricated with inward top and bottom flanges from sheet-metal shallow channel stock, with the channel vertical web providing panel-like unit sides, has like vertical half-sockets of rectangular cross-section located on respective central webs of two opposite sides, with the top flange notched above each half-socket, the half-sockets being located centrally of the base sides for island fixtures or at back corners of half-base units for wall type fixtures. With correspondingly rectangularly shaped, vertically bottom end-slotted, metal post tubes, each inserted into a composite "full" socket formed by two half-sockets of two aligned side-by-side abutting base modules, the adjacent web portions are thereby gripped to lock the units together. A method of base unit fabrication is also disclosed.

13 Claims, 7 Drawing Figures

FRAMING AND MODULAR BASE UNIT STRUCTURE FOR DISPLAY FIXTURES

PRIOR FIXTURE CONSTRUCTIONS

In modern retail stores, supermarkets, merchandise show rooms, high volume merchandizing outlets, certain types of warehousing facilities and various other establishments, shelving, bins, counters, cabinetry, showcase and other structures for display of goods as well as for storage purposes, are provided by fixtures on either side of aisles defined between parallel so-called "island" or gondola fixtures and wall fixtures.

Many fixtures in commercial use for the above purposes are constituted principally of a number of standard quasi-modular, pre-fabricated components and sub-assemblies which are to be assembled as a fixture, on the job.

In a widely used type of fixture, a skeleton or primary structure is formed by a floor supported series array of successively abutting non-equilateral rectangular base units connected as a base structure; and upright framing comprised of spaced posts, secured in the base structure and connected into an upright array, cooperate with each other, and with the base units, first for mutual support, and secondly to support other components of superstructure, such as horizontal decking, counters, cabinetry, vertical divider panels of pegboard and the like serving as dividers and for article suspension. The uprights are appropriately apertured, slotted or otherwise shaped to engage brackets, bin structures or shelving components, which complete a desired superstructure above the base.

These components are intended to provide in the final fixture assembly a strong rigid fixture construction which is safe not only internally against damage by design-intended and reasonable loadings, but also, from the view point of stability and safety to persons frequenting the environment of fixture installation.

By prior practice, in gondola fixtures, for example, typically a welded metal frame type base unit would be 60 inches long and from 30 to 48 inches wide, with perhaps a somewhat smaller end unit used to terminate a run or series array of longer base units; the units incorporating post-receiving sockets disposed to support a series of spaced coplanar posts further rigidified by horizontal spacer or joiner bars.

Thus a rectangular "starter" base would have (on its longitudinal centerline) a central square post socket, and at each end, end sockets projecting from the end faces of the unit by half the horizontal socket dimension. To the starter base could be added at one or both ends one or more successive so-called "intermediate bases", each similar to a starting base in the disposition of a center post socket and of a post socket projecting at one end, but at the other end having a correspondingly placed recess adapted to receive an interfitted projecting socket structure of either a starter base or of a like preceeding intermediate base.

Of course, shorter base units half the size of intermediate bases also could be used having at one end a projecting single full socket and at the other end a recess; and as well, to terminate one or both ends of an aisle, end units could be used having a simple recess for accommodating the projecting socket structure of the second last base element in the island. For free standing wall fixtures, analogous base units would be used similar in length to but smaller in width than the gondola base units.

With such prior construction, there are various disadvantages or untoward features. Thus to secure the successive base units together, fastening means have to be used, such as clips or bolts through appropriate base apertures. This is a distinct disadvantage apart from other untoward features such as the cost of fabrication entailed in particular socket constructions, or in providing the recesses and the projecting structure of end sockets. Also the endwise projecting socket is subject to damage and distortion in handling, shipping and the like operations; and it increases the packaged length of the respective unit.

Further, because of the required fastening of successive bases together, the costs in fabrication of the same to provide for this expedient, and the additional costs and labor in the assembly, practical economics generally dictate the use of the long 60 inch base. This in turn, because of size, from the manufacturer's view point is disadvantageous both in the more awkward handling of components in fabrication, larger tooling required and in the added difficulties and work in handling the finished base for inventory, packaging and shipping purposes.

Moreover, apart from the terminating end base units, for each fixture style (i.e., wall and gondola) at least two types of base components must be manufactured, iventoried and furnished to provide the probable necessary components for any fixture installation; namely, at least one starter base plus whatever additional intermediate base units would then be required to afford the length desired, for the particular fixture installation.

GENERAL DESCRIPTION AND OBJECT OF INVENTION

By the present invention there is proposed a truly modular base unit construction whereby each base unit is provided, entirely within the confines of a hollow rectangular or square plan outline and centrally on opposite sides each of a channel shaped cross section, with a respective half-socket of rectangular shape defined by a vertical web of the respective side and a thereto -welded inwardly located channel-shaped weldment. Two such modules, abutted with the half-sockets adjacent, form a "composite socket" symmetrical about the two abutting web layers of metal constituting the abutting sides of the units, which is adapted to receive the bottom end of a vertical post tube, end -slotted vertically for about the height of the base, but otherwise of known form for engaging with dividing panelling or pegboard, and also shelving brackets.

In the composite socket thus formed by the adjacent modules, the post slot over its vertical extent embraces and holds together the two web layers of the respective side faces of the modules, while at the same time itself is embraced by the two half-sockets provided by respective modules to afford a rigid secure upright disposition of the post. When it is desired to terminate a base structure in a standard base unit with a post at its outboard end, a small dummy socket structure is placed against the unit end to complete the composite socket needed to give firm post disposition.

For free standing wall fixtures, a similar base unit structure is used with, of course, the unit narrowed with placement of the sockets at back corners.

Thus the adjacent modular base units are held together by the insertion of the post element, obviating punching or slotting of appropriate apertures in the base units for reception of bolts or other fasteners, as well as need for further material, parts and labor involved in the assembling operations by such prior art practice.

Further, with the socket structure of the invention, the external periphery of the base units is flat, without projection; for all of the socket structure as such is disposed at an inward internal location of the unit where it is little subject to damage in handling in any operations of fabrication, storing, packaging, shipping and subsequent operations at the point of fixture assembly. The actual extreme length is shortened for storage and packaging advantage as well.

Moreover, though the basic concept and structure thus described can also be used if desired in larger modules, say of rectangular shape elongated along what would be the intended length of the fixture, and provided with a central post socket, the disclosed structure particularly renders smaller rectangular or even square modules economically feasible and attractive, because of the simplicity of assembly and the joining of successive modules by the posts, which would in any event be ordinarily required for support of the rest of the fixture "superstructure ".

Where posts are to occur at the same spacings along the fixture centerline, from asembly labor consideration for mere upright placement, it is practically immaterial whether the posts should be placed in the typical prior socket construction or into the composite sockets formed by the modules of the present invention, but considerable economies do otherwise arise.

Hence, despite a perhaps somewhat greater metal cost to the extent of the metal contained in one unit side in each two units used by the present invention, with each unit being of "half-size" as compared with prior art practice, there are decided further advantages in costs and operations of fabrication, storage, and ease in handling of smaller base units both for manipulation and placement in the final assembly, also in the smaller length increment involved in each module added, so that in all there is greater flexibility in handling, planning and use for various places of fixture installation. With the smaller length increment, base leveling operations are generally expedited. Also a stronger, more rigid and durable base and skeleton structure is obtained.

Particularly importantly by the present invention, for the skeleton or basic fixture construction only two types of base units are required; the standard base module plus an end terminating base unit, in contrast with the three types required by prior practices of similar or comparable type constructions. Especially by eliminating need for a special so-called starter base, and for planning production of and inventorying this special type component, and assuring the inclusion of the same in every order shipped, general fabrication and distribution operations and manipulations are simplified.

Further in the end base unit a single similar half-socket may be used on one side intended to butt against a preceding standard modular unit in a similar fashion to secure the end unit in position.

By virtue of a smaller size and specific modular structure enabled by this method of post securement and modular securement, the module is more readily fabricated, and at lower cost, as compared with the base units of prior art design and structure above described.

In manufacturing the standard base units for a gondola fixture, strip sheet steel stock is roll-formed to a shallow broad rectangular channel section and at the same time all required slots and apertures are made. The channel section stock is then formed into like square-bottomed U-shaped elements or "half -frames", with the channel stock flanges disposed inwardly; pairs of the U-shaped elements are welded together at the free ends of their respective legs, in precisely dimensioned rectangular or square form; channel-shaped half-socket stampings with coplanar outward flanges at the free edges are welded to the inside web faces of the central part of the welded sides of each unit frame to form rectangular half-sockets; the half-socket stampings preferably having been first welded to the ends of a longitudinal central reinforcing member of similar channel stock; and the basic module is thereby essentially completed. Certain other structural features may be incorporated as desired in the roll forming, or other subsequent welding operations, as will be hereinafter described. *Mutatis mutandis*, end base units are similarly fabricated, with a single half-socket, with the central member being omitted; and so also the base units for a free standing wall style fixture.

The general structure and mode of assembly for the base units of this invention are such that quite precise tolerances for product overall shape and dimensioning are readily attained with relatively simple tooling. Further, the necessary components are such that indeed all of the welding, which may be spot-welding, for the fabrication of the primary square or near square outline frame, with incorporation of the half-sockets and the joining central strut (or for incorporating a sub-assembly of a central strut member with the half-socket stampings) can be carried out at a single work station and, as it were, in a single spot welding operation.

For the upright post tubes, the rectangular tube type commonly used in the prior art is suitable, being commercially available already formed first, on one pair of opposed faces, with appropriate standardized slotted aperture series for receiving standardized securements of or for bracket arms or other mounting devices; and secondly, with respective central longitudinal grooves on another pair of faces to receive in a tongue-and groove type engagement the edges of rigid divider panelling or pegboard. Such post tubing apart from cutting to appropriate lengths requires only an end sawing or slotting operation to produce the central slot corresponding in length to the height of the channel stock web of the primary base module.

Other details of method and useful structure ancillary to the above mentioned essential structure will be described hereinafter in detail.

It is the general object of the present invention to provide an improved form of base structure and skeleton construction for display fixtures and like fixtures.

Another object is to provide a modular base unit for base construction of the type described.

Another object is to provide a skeleton structure for fixtures of the type described in which upright post elements secure base units together.

Another object is to provide a skeleton structure, the components of which, especially base components, are easily fabricated with savings in overall costs, which reduces the number of base units required for a given fixture type, and as well the costs of assembly at the installation site.

A further object is the provision of a modular base unit which eliminates need of special fastening elements to secure base units together as a larger base structure in the erection of the fixtures of the type described, while yet obtaining a stronger more durable and rigid base structure.

Other objects and advantages will appear from the following description and the drawings wherein.

GENERAL ARRANGEMENT OF FIXTURE

Figure 1:
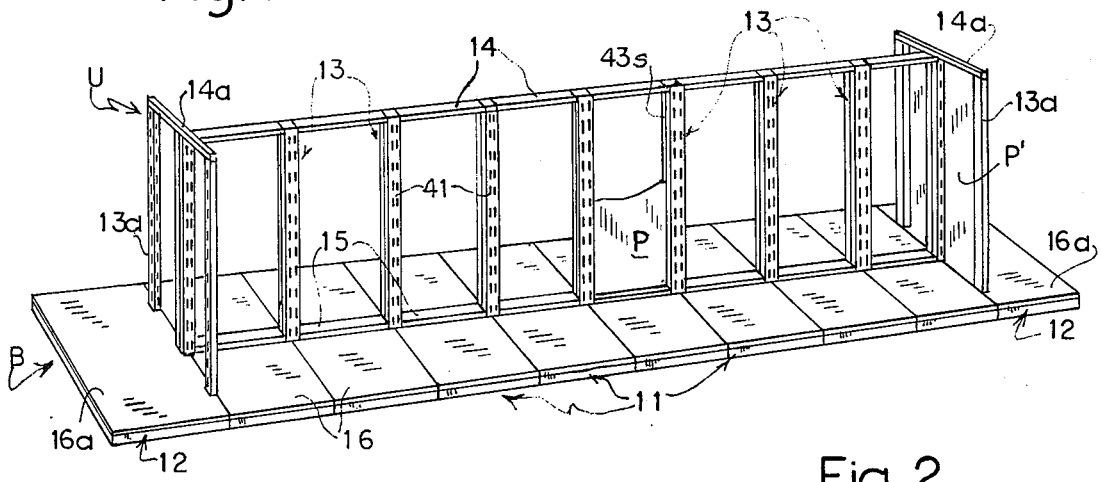
FIG. 1 is a generalized and schematic view of the skeleton or basic structure for a fixture in accordance with the invention, showing base units and upright tubes in assembled condition.

For one embodiment of the invention, in FIG. 1 there is shown the base and framework, as it were the "skeleton" structure for an island gondola type display fixture. This in general construction and appearance is similar to well known prior art arrangements, insofar as comprising an elongated base structure B provided by a series or linear succession of abutting individual floor-supported base units, but here all identical standard base units 11, in the main part of the base run, which is terminated at opposite ends by end bases 12; and for superstructure support, an upright framing U provided by a central longitudinal coplanar array of vertical upright posts 13 with bottom ends received in base assembly sockets. Posts 13 support divider panels P and their top ends are joined by appropriate spacers or tie bars 14; and at each end base a pair of posts 13*a* which in turn are joined by top tie bars 14*a*, also secured to the top of each of the respective endmost posts 13. Longitudinal central divider structure on the base deck is provided across the top of the respective base unit by a central divider bar 15 between each pair of posts. Usually from aesthetic considerations, a single cap rail of inverted U form (not shown) running for the full length of the upright array is applied over the aligned top tie bars.

To provide a horizontal support surface of the base structure, respective decking panels 16 or 16*a* are secured to each base 11 or 12 by appropriate means; each panel 16 extending inwardly to the divider 15 as a stop, which itself is a part of, or is appropriately secured to, the respective base unit.

For the vertical post tubes 13 there may be used a conventional generally rectangular section steel tube having over its entire length on the fore and back sides a respective vertical series of paired vertically extended slots or other appropriate apertures providing points for selectable securement, at appropriate spacings, of brackets or anchor devices for supporting shelving or other superstructure components to be incorporated on the fixture skeleton. On the other opposed tube faces, longitudinal grooving, coplanar in a plane perpendicular to the plane of the post end slot, or analogous structure is adapted to receive divider panels P of tempered Masonite sheeting, pegboard, or similar panel structure, supported between the adjacent pairs of adjacent posts. The divider bars 15 and the underfaces of top tie bars 14 likewise have longitudinal channels or grooves opening upwardly and downwardly to receive and support the respective panel bottom and top edges.

Similarly respective vertical panels may be secured within the rectangular frames formed at each fixture end by the posts 13*a* and cross tie bar 14*a;* for example with a panel resting directly on the end decking 16*a* and its side edges by clips secured to the opposed faces of these posts, and by top edge engagement in bar 14*a*, or by other means not here specifically relevant.

GROSS STRUCTURE OF BASE MODULES

Figure 2:
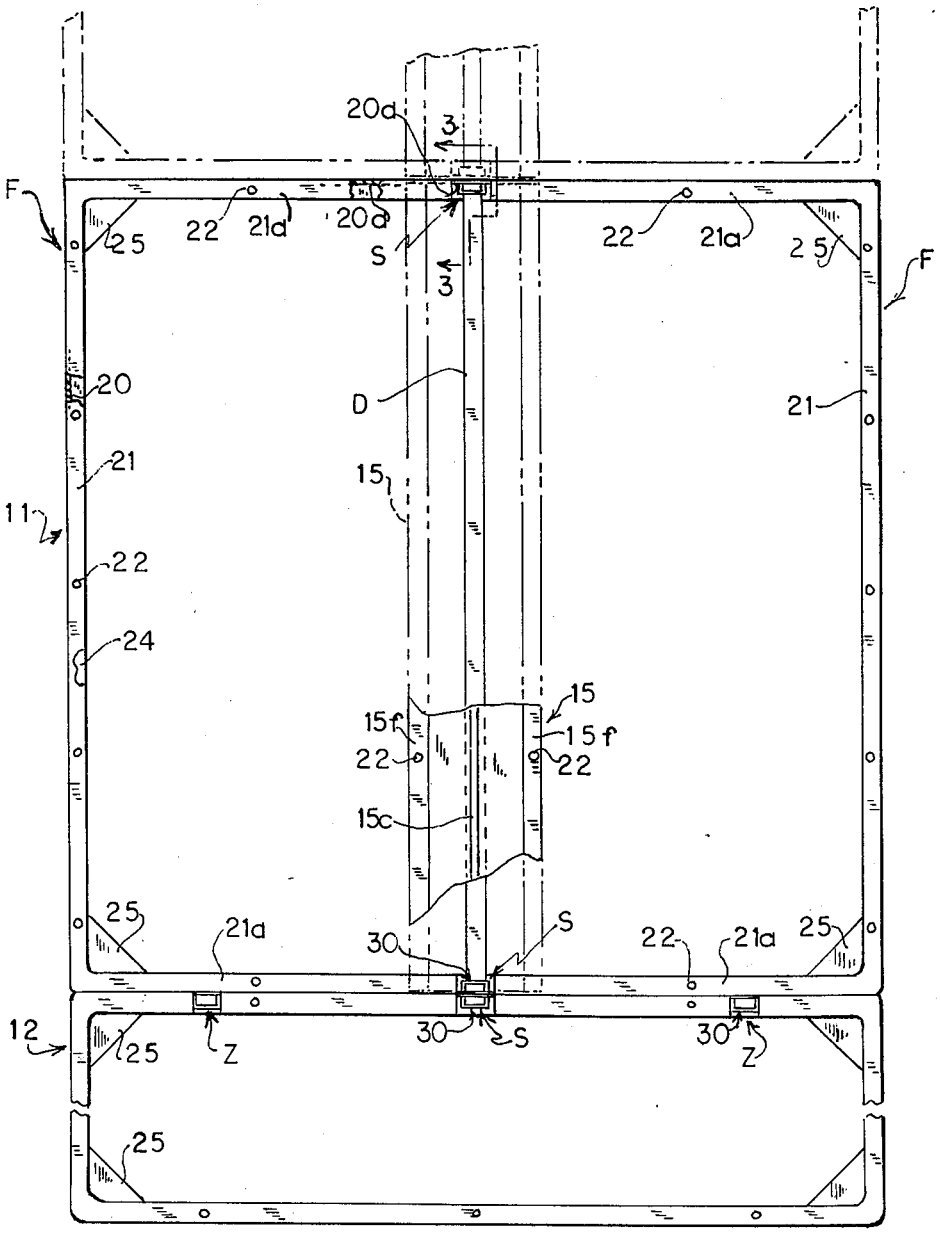
FIG. 2 shows, in plan and in full lines, the structure of the primary modular unit and, positioned adjacent thereto, an abutting end base unit, and also fragmentarily an adjacent similar primary module.

Each standard base unit 11, as further shown in FIG. 2, in plan outline, is constituted of a hollow square or near square rectangular frame F as a main component fabricated from shallow, broad, roll-formed sheet steel channel; for example, 20 gauge hot rolled sheet steel in a 30 inch square frame but also running to 36 or 48 inches in fore and aft dimension with a 30 inch length for typical fixture designs; at the center of two opposed sides, half-socket structures S as hereinafter described; the frame F being spanned by a central reinforcing bar or strut D conferring added rigidity to the base. In the frame F, elongated, short panel-like vertical longitudinal and end sides 20, 20*a* which are straight and substantially flat without projections and with the top and bottom edges inwardly flanged, are provided by the channel web as a frame side panel and flange portions.

The frame F actually is comprised of two similar flat bottom U-shaped half-frames with opposed aligned legs welded together at the socket region as hereinafter described.

The frame top flanges 21, 21*a* of the longitudinal sides and of the end sides and so also the flanges 15f of the divider bar 15 are provided with apertures or bolt holes 22 for securement of decking 16, by screws or the like; while the bottom flanges 24, 24*a*, in the corner region are appropriately apertured for the adjustment screws (not shown) of conventional leveling plates 25.

The divider bar 15 (see FIGS. 2, 3), is an inverted shallow rectangular sheet metal channel section, with its downward sides terminating in oppositely outwardly directed coplanar flat flanges 15*f*, through which at opposite ends the divider 15 is spot-welded on the top of the flanges 21*a;* the bar ends being notched to leave exposed the half-socket structures S. Also in one or more locations reinforcing may be used for the central part of the bar 15 such as gussets welded to the flanges 15*f* and to the central strut D.

Centrally along the top of divider 15 there is spot-welded a small sheet metal channel 15c upwardly open to receive the bottom edge of a respective vertical divider panel P; through the channel 15*c* may be spot-welded to the top flange 33 of the strut D (as at 15*cx* FIG. 5), if it is desired to omit the divider bar 15. However, the respective panel P may rest directly on the strut top flange 33, which preferably is somewhat widened for this purpose, to support the opposed inner edges of the decking sheets extending inward to, and in effect defining a slot to hold captive the bottom edge of, panel P.

SOCKET STRUCTURE, DETAILS OF FRAME WELDMENTS, MODULE SECUREMENT

Figure 3:
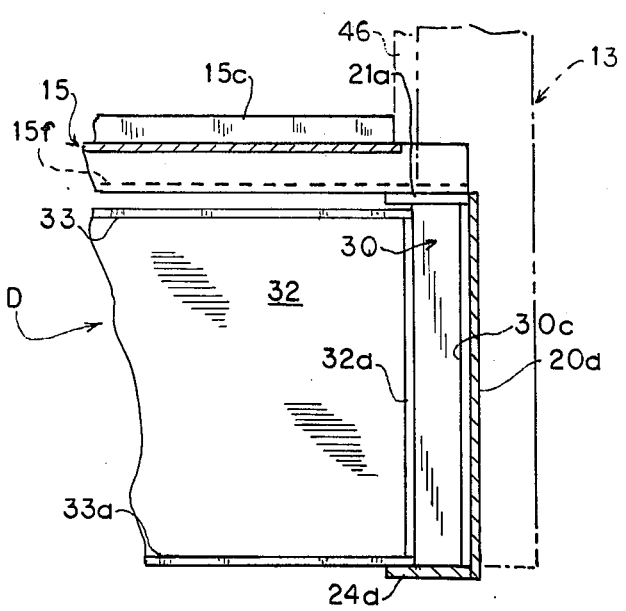
FIG. 3 is a fragmentary enlarged detail in section taken as indicated at 3—3 in FIG. 2, but also indicating a slight modification from FIG. 2.
Figure 4:
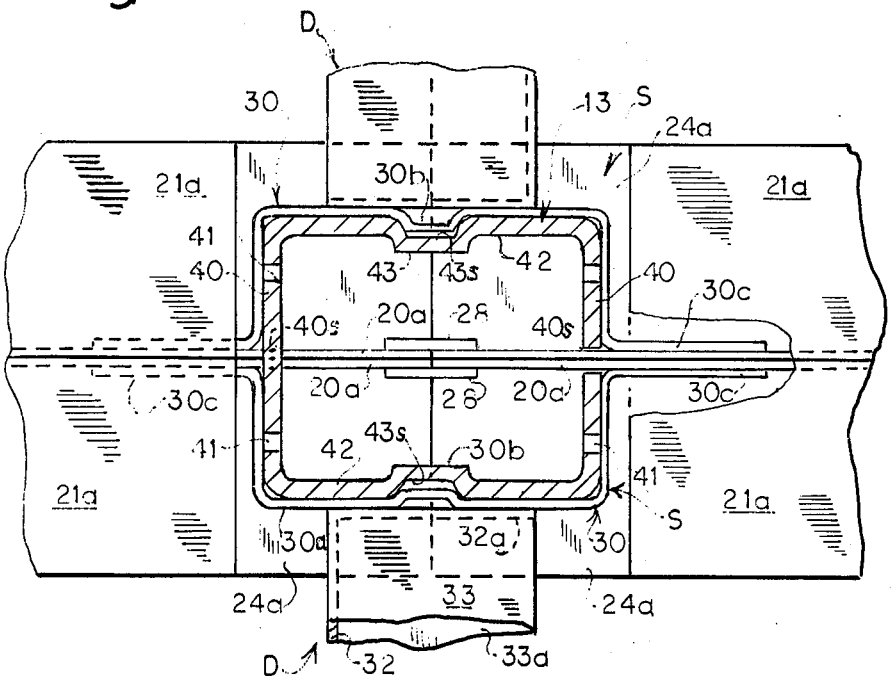
FIG. 4 is an enlarged fragmentary detail partly in plan and partly in irregular section, showing details of the post tube mounting sockets and module-securing structure.

Joining details of the unit frame F, and of the half-socket structure are seen in fragmentary enlarged FIGS. 3 and 4. In FIG. 4, portions of the abutting end sides of two adjacent base modules are seen in plan; and, in generally horizontal but somewhat irregular section, the bottom end of the upright post 13 received in a composite socket provided by the juxtapositioning of two half-sockets S of adjacent modules; which post further serves to secure the abutting modules together without need of additional fastenings.

Actually each frame F is constituted by welding two U-shaped half frames together, in the vertical web regions of their free ends.

For each module (see FIG. 4) the vertical channel webs 20*a*, of the frame channel section structure which afford the wall panel of the base units, are aligned coplanar and in effect spliced by spot-welding to a respective vertical splice plate 28 disposed on the inner side of the respective module wall. The bottom flanges 24*a* are shown as simply abutting, while the top flanges 21*a* are notched for access to the deep half-socket structures next described.

Each half-socket is defined by welding to the respective end wall or panel a formed sheet metal socket element 30, of generally broad flat-bottomed channel shape in horizontal section, extending from the frame bottom flange preferably at least up to the top flange. A pair of broad coplanar outward flanges 30*c*, at the stamping channel mouth, provide area for the welding to the vertical inside face of the respective frame channel web. The breadth of the half-socket is slightly larger than the corresponding cross section long dimension of a rectangular section post to be received therein; the shorter internal dimension of the socket being somewhat less than half of the other dimension of the rectangular post section; that is, the dimension from the outer face of the end web to the parallel inner face of the stamping 30 is again slightly larger than half the corresponding dimension of the post cross section.

Thus, when base unit modules 11—11, or 11—12 are abutted and aligned, the two half-sockets form what may be termed a composite socket for post reception. A vertical inward rib 30*b* extending over the entire vertical length of the stamping 30 is shaped for the purposes hereinafter explained.

Central bar D is again fabricated of roll-formed channel stock similar in section to the main frame material. By shearing off top and bottom flanges 33, 33*a*, at each end region to form a residual tongue or projection of the vertical web 32 at each end, and then bending the tongue inwardly to a right angle, a respective tab 32*a* results for spot welding to the external face 30*a* of a corresponding socket stamping.

This arrangement of the bar D spot-welded into the socket structures in effect confers additional metal and rigidity to the sockets welded on its respective ends.

If desired, at both ends of bar D, which overlap locally both sides of the abutment lines of the frame bottom flanges 24*a*, the bottom flange 33*a* may be spot-welded to the main frame F to supply additional rigidity.

Post 13 as shown in FIG. 4 is a conventional commercially available post tube which in each of the opposite sides 40 (facing front and back of fixture) has a vertical series of slot pairs 41, for selectably positioned securement of bracketing for shelving or for mounting of other post-supported structures; and its other pair of opposed sides 42 has central longitudinal coplanar insets 43, forming in each side a central longitudinal external slot 43*s* over the tube length for receiving a vertical edge of a respective panel P mounted between successive uprights. The above-mentioned inward ribs or offsets 30*b* of the sockets are shaped to engage in the post grooves thereby further gripping, and increasing rigidity of disposition for, the posts received in the sockets.

Figure 6:
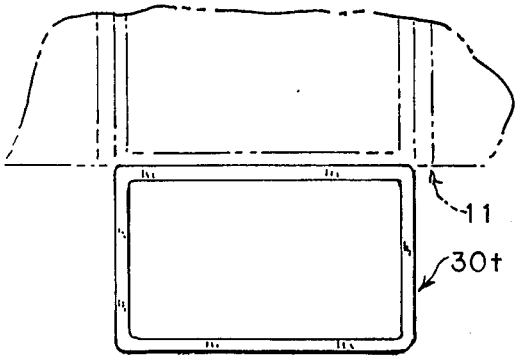
FIG. 6 is a plan view of a dummy socket.

At the bottom end, each post is centrally slotted upwardly at 40*s* in opposed walls 40, thus in effect providing a post slot upward for a distance at least equal to or slightly greater than the frame wall panel height, i.e., the web height in the frame channel section. The slot width is just slightly greater than twice the thickness of the web or wall panel, that is, the frame sheet metal stock thickness, thereby to accommodate the adjacent abutting vertical side panels, i.e., webs, of two modules; so that upon insertion into the socket, the post end thereby serves by virtue of the slot engagement with the abutting webs as a fastener for the abutted modules.

Where an end unit 12 is not to be used, preferably for post tightness a full composite socket is formed by use of a "dummy socket" element (see FIG. 6) which may be merely a simple short rectangular section tube 30*t* with metal thickness similar to that of the frame web; or the dummy may be comprised of a half-socket stamping 30 spot-welded to a flat sheet piece.

Alternatively for posts 13 there may be used (see FIG. 5) a hollow rectangular section tube 13*x* in which the sides 42 are flat, without offset, but have a small, light-gauge formed sheet metal U section 46 welded thereon affording a vertical panel edge receiving slot (see FIG. 5); the element 46 terminating short of the socket stamping so as not to interfere with appropriate full reception of the posts. In such case the inward rib 30*b* is accordingly omitted from the socket stampings 30*x*.

Figure 5:
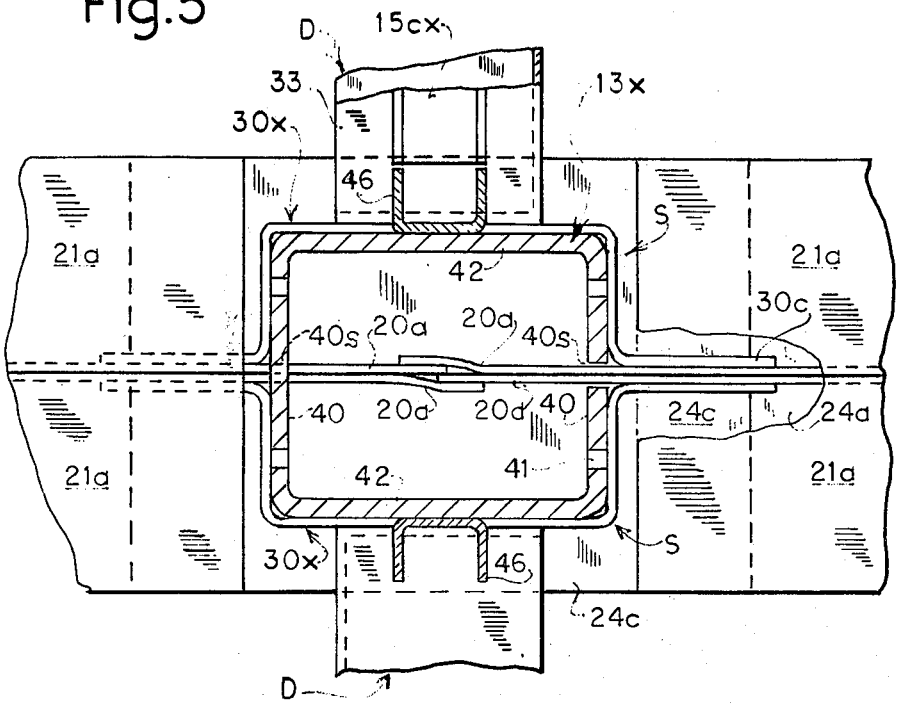
FIG. 5 is a view similar to FIG. 4, showing certain variations in the tube and module structure.

Also in FIG. 5 there appears a further minor variation in the structure of the modules wherein a corresponding part of the bottom flange 24*a* is sheared away simultaneously with the shearing or notching of the top flange 21*a*, and the U-shaped half-frames have their legs somewhat longer than one-half of the corresponding end wall side length to overlap for spot-welding to each other. The bottom flange in effect is reconstituted by spot-welding a plate 24*c* onto the adjacent ends of the sheared bottom flanges 24*a* thereby to close the socket bottom after the welding of the two half-frame components. This modification, in contrast with butting the leg ends, has the decided advantage of enabling fabrication set-up procedures which absorb tolerances in the leg length dimension, that is, by enabling the dimension parallel to the welded legs to be closely established by appropriate gauging to either the inside or outside faces of the longer frame sides or webs 20, with any leg length variation being accommodated by the overlap.

END BASE

The end bases 12 have a structure generally similar to that above described for the bases 11, and may be fabricated in similar fashion, but with omission of one half-socket, and even of strut D. Preferably for the type of upright frame structure shown in FIG. 1, the end side wall in a unit 12, intended to abut against the standard penultimate base 11, includes further like half-socket structures Z symmetrically located on either side of the socket S adapted to receive upright tubes or posts 13*a* of smaller cross section than the posts 13, which do not serve any module-connecting function in the base region. However, in some cases the bottom ends of uprights 13*a* may be located and fixed by other expedients, such as end notching to provide a projection into a cutout into underlying supporting structure of decking or frame.

WALL STYLE FIXTURE BASES (FIG. 7)

Figure 7:
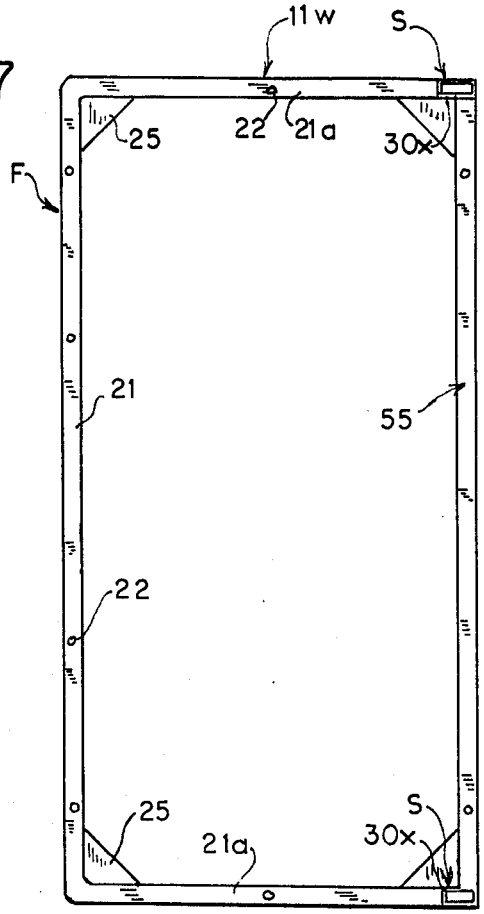
FIG. 7 is a plan view of a standard base unit for a free standing wall fixture.

The half-base units for a free standing wall type fixture (see FIG. 7 for a standard unit 11*w* where analogous parts bear identical reference numerals to those of FIGS. 2–4) are comprised essentially of a single U-shaped half-frame and, to close the open side of the half frame F and to form the wall adjacent side of the frame, a "straight" member 55, actually having short right angle end projections to which the ends of the half-frame are spot-welded, with the half-sockets S occurring in the frame corners adjacent member 55. The socket stampings 30*x* are preferably modified say to a somewhat Z-bar or better W-bar-like cross-section to utilize the corner of the resulting frame, hence two sides of the frame with appropriate notching of the top flange on both sides of the corner, to jointly define the half-socket; with the modified stampings then spot-welded to corner-adjacent side portions of the frame. Composite sockets then are formed by abutting base units which are secured in a skeleton assembly by use of the same type of uprights as in the gondola style.

ASSEMBLY

With this arrangement an island fixture is easily constructed simply by placing a first end base 12 in appropriate position on the floor with due leveling; bringing into aligned abutment therewith and leveling a first standard base unit 11, and inserting a post 13, and if desired, posts 13*a;* in a like fashion adding in a successive series, a number of standard base units as needed for the desired fixture lengths, considering end units to be used; and finally adding a terminating end unit 12. Alternatively the entire series of bases may be abutted and aligned with half-socket coincidence and thereafter the posts may be emplaced in the sockets, simultaneously joining the abutting units engaged by each posts.

Thereafter top deck panel sections 16 are placed in position on the base units and secured by bolting or other appropriate fastener means.

The vertical panels P dividing one side of the gondola from the other are then slipped into place between the posts 13; and also panels P′ between posts 13*a* if the latter are adapted to panel edge engagement; and the top tie bar element structures 14, 14*a* (or one continuous element in place of separate elements 14) are added and bolted into place, thus securing the components of the basic framing or skeleton structure of the fixture. To the completed rigid skeleton thereafter may be added desired conventional counter structure, shelving brackets and shelving, bin components, or whatever else of superstructure is desired to be supported by and incorporated on such skeleton for the completed fixture.

Free standing wall fixture structures are assembled in essentially the same fashion.

FABRICATION METHOD

Sheet steel strip stock of appropriate gauge and characteristics is roll-formed continuously or into lengths with the described channel section; and, preferably simultaneously with the roll-forming, appropriate apertures, slots or notches, are punched through or sheared from the top flanges 21, 21*a* for decking panel securement, and also for access to the regions where the half-sockets are to occur. Appropriate lengths of the channel section are cut off at the notched flanged regions, and formed into the described U-shaped half-frame elements which then are brought into appropriate disposition to be jigged in suitable tooling either for spot welding of overlapped portions at the free respective ends thereof, or butted and spot-welded to a splicing plate 28 as previously described. The half-sockets may be applied subsequently to or may be emplaced and jigged simultaneously with the half-frames, for the frame welding. But also sub-assemblies each comprised of a channel section center bar D, with the respective "half-socket" stampings already spot-welded thereon, are brought into position on and secured to the inside of the webs on the respective frames F by spot-welding along the stamping flanges. The welding securement of the divider bar 15, with its element 15*c* already in place, then follows, completing the unit. Where a divider bar 15 is not to be used, but strut D is to carry a U-section, preferably the latter is welded into place in the sub-assembly of bar D before the latter is incorporated into the base unit.

What is claimed is:

1. For a floor-supported fixture, such as a gondola fixture or a free-standing wall fixture, including as a skeleton structure a plurality of rectangular base units successively abutted in a linear array on a floor to form an extended base structure, and a plurality of horizontally spaced upright posts received by respective sockets in the base structure and secured in a coplanar array as upright framing in superstructure of the fixture, the improved skeleton structure comprising:

a base unit module structure provided by an open frame of sheet metal generally rectangular in plan outline, and having at least one pair of opposed sides, each with a straight vertical side panel, affording respective end faces of the module, whereby like modules may be abutted end-to-end with face-to-face contact, on an inward face of each said side panel a respective upwardly open half-socket formation vertically extended over the height of the respective side, whereby a pair of like modules, placed in aligned abutting relation, form a composite socket symmetrical about the abutment plane, a plurality of modules disposed in said relation; and, received in each composite socket, an upright post having a bottom end vertically slotted and in exterior cross section generally complementary to the interior shape of a said composite socket with the end slot of the post accepting abutting side panel portions occurring within the sid composite socket thereby to secure abutting modules together in a base structure.

2. The skeleton structure of claim 1, including in combination an end base unit having a single, half-socket-bearing side panel as described for said module structure, said end base unit disposed with its said side panel abutting an exposed side panel of a module at one end of said plurality thereby to form a further composite socket; and a said post received in the last said socket to secure the end base unit as a part of said base structure.

3. The skeleton structure of claim 1, including in combination a dummy socket comprising a rectangular tube element in height substantially equal to the height of a said module and in cross-section corresponding to a said half-socket formation, said tube element disposed with one side, as a panel part, abutting an exposed side panel of a module at one end of said plurality, said dummy socket and a half-socket of the last said module also forming a composite socket; and a said post received in the last said composite socket.

4. The skeleton structure of claim 1, wherein each said upright post is provided with two respective longitudinal groove formations coplanar on opposite sides of the post in a plane perpendicular to the plane of the post end slot, and adapted supportingly to receive edges of a divider panel, engaged between adjacent posts, as a part of fixture superstructure.

5. The skeleton structure of claim 4, wherein each said upright post has a rectangular transverse cross section to present four post faces, with two opposed faces bearing the said groove formations, and with the other two faces having like longitudinal series of spaced apertures for engagement of mounting elements of further components in said superstructure.

6. The skeleton structure of claim 1, wherein each said half-socket formation is centrally located on the length of a respective side panel, whereby the skeleton is adapted for a gondola type fixture.

7. The skeleton structure of claim 1, wherein said half-socket formations are located at respective corners of, and adjacent the same longitudinal side of, the module frame, whereby the skeleton is adapted for a free-standing wall type fixture.

8. The skeleton structure of claim 1, wherein the sides of the frame of a said module each have a shallow broad channel section, with the channel web providing the respective said side panel and with the flanges of the channel section being inwardly directed top and bottom flanges of the side panel.

9. The skeleton structure of claim 8, wherein each said half-socket formation is defined by a vertically running channel-like stamping having outward longitudinal flanges along the channel mouth secured to the inside face of the respective said side panel of the frame;

the top flange of the frame above each half-socket being notched away for access to the half-socket.

10. The skeleton structure of claim 9, wherein each said half-socket formation is centrally located on the length of a respective side panel, whereby the skeleton is adapted for a gondola type fixture.

11. The skeleton structure of claim 10, wherein said base unit module structure includes a longitudinally extending central divider bar with opposite ends secured upon respective top flanges of the said opposed sides of the frame, said divider bar comprising an inverted, broad shallow channel section with the channel section sides flanged outwardly away from the downward channel mouth into coplanar longitudinal flanges, said divider bar being secured by welding of its flanges to underlying portions of the top flanges of the said opposed sides of the frame at either side of a respective half-socket; each divider bar end being notched to accommodate a post received at the underlying half-socket.

12. The skeleton structure of claim 10, wherein said base unit module structure includes a strut with opposite ends secured to respective half-socket formations, and above said strut an aligned horizontal groove formation to receive the bottom edge of a respective divider panel.

13. For free-standing structure including a base formed by a plurality of at least two abutting base units forming a composite base structure, and at least one upright post, received in a respective socket of the base structure, the improved structure comprising in combination:

in each base unit a sheet metal frame providing an externally straight, horizontally elongated, vertical side panel affording a respective face for face-to-face abuttment with a like unit; and centrally on the length of the inward face of said side panel, a respective upwardly open half-socket formation extended vertically over the height of the respective side, whereby a pair of like base units, placed in aligned face-to-face abutting relation, form a composite socket symmetrical about the abutment plane;

a pair of units disposed in said relation; and an upright post with bottom end received in the composite socket;

said post having its bottom end vertically slotted and, in exterior cross section, generally complementary to the interior shape of a composite socket, with the post end slot accepting the abutting side panel portions within the socket thereby to secure the abutting units together in a base structure.

* * * * *